US005203556A

United States Patent [19]

Smith et al.

[11] Patent Number: 5,203,556

[45] Date of Patent: Apr. 20, 1993

[54] METHOD AND APPARATUS FOR THE SEQUENTIAL HANDLING AND DELIVERY OF FLEXIBLE PRODUCTS

[75] Inventors: David A. Smith, Midland; Robert J. Nestle, Essexville, both of Mich.

[73] Assignee: Dowbrands L.P., Indianapolis, Ind.

[21] Appl. No.: 956,571

[22] Filed: Oct. 5, 1992

Related U.S. Application Data

[63] Continuation of Ser. No. 606,217, Oct. 31, 1990, abandoned, which is a continuation-in-part of Ser. No. 286,205, Dec. 19, 1988, Pat. No. 5,014,978.

[51] Int. Cl.[5] ..... B65H 29/54; B65H 29/32

[52] U.S. Cl. ..... 271/308; 271/196

[58] Field of Search ..... 271/96, 108, 196, 307, 271/308, 310; 74/395; 209/553

[56] References Cited

U.S. PATENT DOCUMENTS

| | | | |
|---|---|---|---|
| 3,369,436 | 2/1968 | Loase | 74/395 |
| 3,516,297 | 6/1970 | Dollinger | 74/395 |
| 3,916,790 | 11/1975 | Alix | 271/108 X |
| 4,024,814 | 5/1977 | Becker | 271/276 X |
| 4,474,367 | 10/1984 | Jongerling et al. | 271/276 X |
| 4,754,962 | 7/1988 | Kontz | 271/196 X |
| 4,911,423 | 3/1990 | Smith et al. | 271/196 X |
| 4,919,415 | 4/1990 | Smith et al. | 271/196 X |
| 5,014,978 | 5/1991 | Smith et al. | 271/308 |
| 5,062,603 | 11/1991 | Smith et al. | 271/196 X |
| 5,062,623 | 11/1991 | Smith et al. | 271/196 X |

FOREIGN PATENT DOCUMENTS

| | | | |
|---|---|---|---|
| 3365 | 1/1989 | Japan | 74/395 |

*Primary Examiner*—Robert P. Olszewski
*Assistant Examiner*—Boris Milef

[57] ABSTRACT

A method and apparatus for the sequential handling and delivery of individual flexible products, such as plastic bags or containers, is provided which enables the use of extended length orbital packer fingers for removing closely spaced flexible products from a transfer drum and delivering them to a stacking table. The apparatus includes a product drum for delivering a series of closely spaced individual flexible products to a transfer point, and a transfer drum positioned at the transfer point for transferring the flexible products to a delivery point while maintaining substantially the same spacing between the products. Adjacent the transfer drum is an orbital packing mechanism including a shaft mounted adjacent the transfer drum for orbital movement and a plurality of packer fingers secured to the shaft and extending into the annular grooves for removing the flexible products sequentially from the transfer drum and delivering them to the delivery point. The fingers are preferably designed to extend and contact across substantially the full width of the flexible products as the products are removed from the transfer drum to prevent bag fold over problems and misalignment in the stacking of the products.

28 Claims, 9 Drawing Sheets

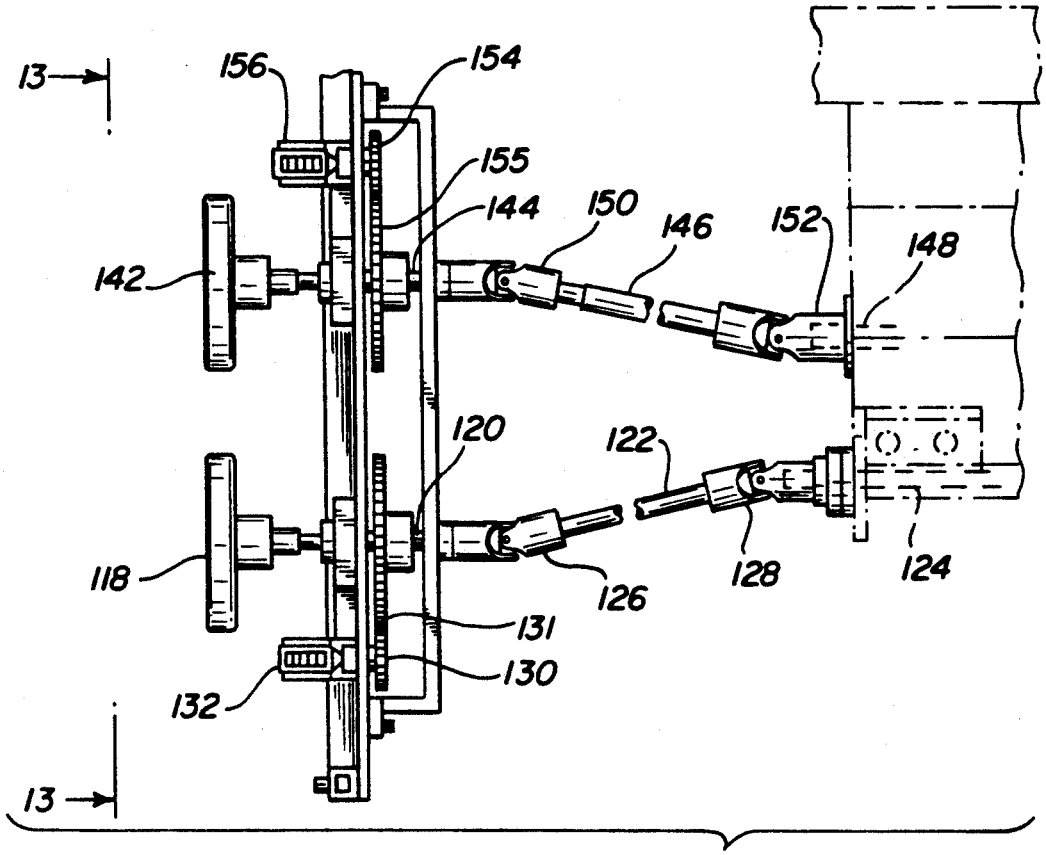
FIG-11
FIG-12
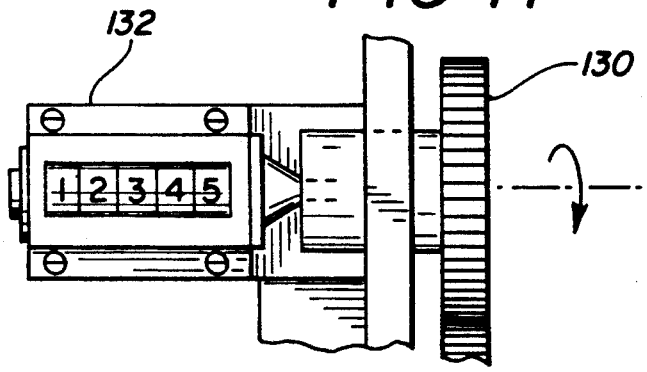
FIG-13
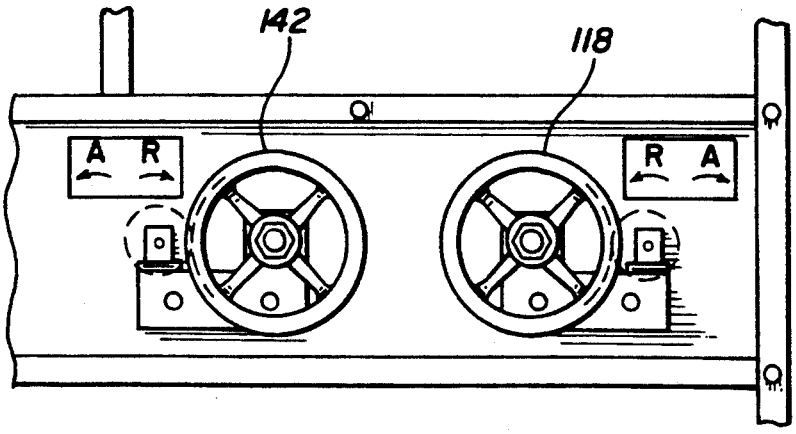

METHOD AND APPARATUS FOR THE SEQUENTIAL HANDLING AND DELIVERY OF FLEXIBLE PRODUCTS

This application is a continuation of U.S. application Ser. No. 07/606,217 filed Oct. 31, 1990, now abandoned, which is a continuation-in-part of U.S. application Ser. No. 07/286,205, filed Dec. 19, 1988, now U.S. Pat. No. 5,014,978, for METHOD AND APPARATUS FOR THE SEQUENTIAL HANDLING OF FLEXIBLE PRODUCTS.

BACKGROUND OF THE INVENTION

This invention relates to a method and apparatus for the sequential handling of a series of individual flexible products, and more particularly to a high speed handling and delivery system for flexible plastic bags or containers.

In the production of individual flexible web products such as plastic containers and bags, the bag stock is typically supplied in the form of a continuous web of thermoplastic material which has been folded upon itself to form two plies. In forming individual bags, portions of the thermoplastic material are severed from the web. These severed areas become side seams for the bags and are typically sealed at the same time as they are severed by the use of a heated wire element. The bags are then stacked, counted, and packaged by packing equipment.

The severing and sealing operation typically takes place on a relatively large diameter rotating drum which may contain multiple heated wire severing and sealing elements positioned in grooves located within the outer periphery of the drum. As the drum rotates, different severing and sealing elements are actuated to raise them up to the drum surface to sever and seal a respective portion of the bag stock web. The individual bags are retained on the drum by a vacuum arrangement as the drum rotates. Since the individual bags are formed from a continuous web, the spacing between successive bags is small, resulting from the melt back of the thermoplastic web material as the side seams are severed and sealed by the heated wire element.

Individual bags are then taken from the drum, stacked, and packaged. Desirably, the packaging operation occurs at the highest possible speed the equipment can be operated to increase productivity of the system. Further, because of the high operating speeds involved, precise timing is required for taking the bags from the product drum and transfer drum. The high operating speeds also make necessary the accurate timing of the stacking and removal of bags during their packaging.

Presently, individual bags are taken from the drum by a smaller transfer drum, also suitably equipped with vacuum capabilities. The vacuum on the bags on the large drum is relieved at an appropriate point, and the bags fall onto the smaller drum where they are held in position by vacuum. At an appropriate point, the vacuum is released and the individual bags are pulled off the smaller drum by an orbital packer or similar device.

As is conventional, the orbital packing device is provided with a set of packer fingers which move in a generally circular orbital path in timing with the smaller transfer drum so that the fingers remove successive bags, which are closely spaced and typically separated on the drum only approximately ⅛ to ½ inch from each other, from the drum and stack them on a stacking table against a generally vertically extending backstop. These orbiting packer fingers must move at very high speeds to strip each successive bag from the drum and may actually accelerate the bags toward the backstop. Such acceleration of the bags is undesirable as the bags may fold, bounce, or crumple when they hit the backstop. This sometimes leads to machine jams, causing excessive downtime for the machinery.

Even if the machinery does not jam, the stack of bags which is formed on the stacking table may be uneven so that when the stack is boxed, bags may be left hanging out of the box. Such boxes must be removed from the assembly line and repacked by hand. Even minor unevenness of the bag stack may make it more difficult for a consumer to dispense the bags from a box. If one or more of the bags in the stack is crumpled, the vertical height of the stack is affected so that when the count fingers are activated to separate the previous precounted stack from the next stack, the fingers may strike the stack. Again, this leads to machine jams and downtime for the machinery.

Another problem in conventional orbital packing devices is that the orbit of the packer fingers is designed so that the fingers contact substantially less than the full bag width as they move out of the grooves and strip the bag from the surface of the transfer drum. The packer fingers and their orbit are designed in this manner to prevent the fingers from contacting the leading edge of the next succeeding bag on the transfer drum as their orbit brings the fingers into and out of the grooves on the transfer drum surface. At typical operating speeds, the fingers accelerate the bags vertically downwardly away from the transfer drum surface at a high velocity. In some instances, this may cause the trailing edge of a bag, which is not in contact with the packer fingers, to fold up and over against itself. A folded bag placed on the bag stack again affects the height of the stack so that the count fingers may not operate properly to separate a predetermined number of bags from the stack. Additionally, such a folded bag may also cause a jam from the next bag striking the folded trailing edge.

A packing device having extended length packer fingers which extend and contact across substantially the full width of the bags is disclosed in commonly-assigned, copending U.S. application Ser. No. 286,205, filed Dec. 19, 1988 now U.S. Pat. No. 5,014,978. However, that application recommends that increased spacing be provided between the bags to avoid problems of the longer fingers contacting the leading edge of the next sequential bag. Increased spacing may be accomplished by increasing the surface speed of the transfer drum relative to the product drum so that bags on the transfer drum are spaced further apart. Additionally, spacing between bags may be increased by 1) employing a side-shifting transfer drum as taught in commonly assigned U.S. Pat. No. 4,911,423, issued Mar. 27,1990, or 2) a plurality of transfer drums as taught in commonly assigned U.S. Pat. No. 4,919,415, issued Apr. 24, 1990.

However, it would be desirable to be able to take advantage of the extended length fingers contacting substantially the entire surface of the bag in conventional equipment having only slight spacing of from about ⅛ to ½ inch between adjacent bags on the transfer drum. Further, it would be desirable to be able to control precisely the timing for the packer and count fingers and vacuum transfer mechanisms so that machine jams and stacking problems can be reduced. Accordingly, the need still exists in the art for a method and apparatus for the sequential handling and delivery of flexible products at high speeds without the folding, jamming, or stacking problems which have plagued prior art orbital packing equipment.

SUMMARY OF THE INVENTION

The present invention meets that need by providing a method and apparatus for the sequential handling and delivery of individual flexible products, such as plastic bags or containers, which enables the use of extended length orbital packer fingers for removing closely spaced flexible products from a transfer drum and delivering them to a stacking table. Further, the timing of the orbital packer fingers is advanced from that of the prior art such that the leading edges of the flexible products contact a backstop on the stacking table substantially at the point where the packer fingers have reached bottom dead center of their orbit. This arrangement reduces the effects of horizontal acceleration of the flexible products as they are delivered to the stacking table and reduces bag crumpling, fold over, and bounce. This provides more uniform stacks and prevents misalignment of the bags which may lead to jamming of the equipment or improper loading of the flexible products into packages.

Additionally, the present invention provides means for adjusting the pick off position of the packer fingers relative to the transfer drum while the apparatus is in operation to insure that the packer fingers do not contact succeeding bags on the transfer drum. Also, the present invention provides means for adjusting the timing of the count fingers relative to the orbital packer fingers while the apparatus is in operation to permit precise control of the count finger "dive" into the stack of bags to separate a predetermined number of bags from the stack. These capabilities of having accessible, external controls for adjustment of the apparatus while in operation provide significant advantages over prior art apparatuses and practices which required laborious trial and error adjustments while the machinery was shut down.

In accordance with one aspect of the present invention, an apparatus for the sequential handling and delivery of individual flexible products is provided which includes means for delivering a series of closely spaced individual flexible products to a transfer point, with a spacing there between of typically less than about ½ inch, and means positioned at the transfer point for transferring said flexible products to a delivery point while maintaining substantially the same spacing between the products. The means at the transfer point include a vacuum transfer drum having a plurality of annular grooves about the periphery thereof, and means for rotating the drum.

Adjacent the transfer drum is an orbital packing mechanism including a shaft mounted adjacent the transfer drum for orbital movement, drive means for orbiting the shaft, and a plurality of packer fingers secured to the shaft and extending into the annular grooves for removing the flexible products sequentially from the transfer drum and delivering them to the delivery point. The fingers are designed to extend and contact across substantially the full width of the flexible products as the products are removed from the transfer drum to prevent bag fold over problems and misalignment in the stacking of the products.

The vacuum transfer drum includes a vacuum source, and a plurality of vacuum ports about the outer periphery of the transfer drum. Communicating with the vacuum source, a series of vacuum ports are arrayed across the transfer drum surface parallel to the rotational axis of the drum to secure associated leading edges of the flexible products to the outer surface of the transfer drum. To insure proper transfer, the vacuum at each successive series of ports is terminated at a point where the fingers come into contact across substantially the full width of the flexible products.

The apparatus also preferably includes means for adjusting the point at which the vacuum to each successive series of ports is terminated, with the adjusting means being capable of operation while the apparatus is in operation. The termination point for the vacuum can be made adjustable by a suitable means such as a movable slug mounted in the vacuum manifold and connected to an external control device which also provides an indication of the position of the slug. The movable slug also preferably includes a threaded adjusting rod and turnbuckle secured to the slug for extending or retracting the position of the slug within the manifold.

The apparatus also preferably includes means for stacking the individual flexible products, such as a stacking table and means for halting the horizontal movement of the flexible products, such as a backstop on the stacking table. To minimize the effects of horizontal acceleration of the flexible products as they are removed from the transfer drum, the timing of the packer fingers is advanced from that typically used in the prior art so that the orbit of the fingers is at bottom dead center when the individual flexible products reach the back stop. This prevents bag crumpling and bounce.

The apparatus of the present invention may also include means for adjusting the pick off position of the packer fingers relative to the transfer drum while the apparatus is in operation. By "pick off position", we mean the point in the orbit of the packer fingers at which the fingers engage the bags and strip them from the transfer drum. This means for adjusting the pick off position may comprise a phaser and also includes means for adjusting the output of the phaser to control the orbiting of the orbital packer shaft and, thus, the positioning of the packer fingers. In this manner, the timing between the orbital packer fingers and rotating transfer drum may be precisely controlled while the apparatus is in operation to insure that the packer fingers do not contact succeeding bags on the transfer drum. This precise control reduces the potential for machine jams and is useful not only for the extended length packer fingers of the present invention, but also for use in conjunction with machinery using conventional length fingers.

The present invention also provides a method for the sequential handling and delivery of individual flexible products which includes the steps of delivering a series of closely spaced individual flexible products to a transfer point, with a spacing therebetween of typically less than about ½ inch, and then transferring the flexible products from the transfer point to a delivery point by transferring the flexible products onto a rotating vacuum transfer drum having a plurality of annular grooves about the periphery thereof.

The flexible products are removed sequentially from the transfer drum and delivered to the delivery point using a plurality of fingers which extend into the annular grooves in the transfer drum. The fingers extend and contact across substantially the full width of the flexible products as the products are removed from the transfer drum.

In a preferred form, the leading edges of the flexible products are secured to the outer surface of the transfer drum by vacuum, and the vacuum on the leading edges of the flexible products is released at the point at which the fingers contact across substantially the full width of the flexible products. The method of the present invention also optionally includes the step of stacking the flexible products as the products are removed from the transfer drum, preferably on a stacking table against a back stop. As discussed previously, the timing of the pick off of the flexible products by the packer fingers from the transfer drum is such that as the flexible products are delivered to the stacking table, the orbit of the fingers reaches bottom dead center as the leading edges of the flexible products contact the backstop.

In accordance with another embodiment of the present invention, an apparatus for the sequential handling and delivery of individual flexible products is provided which includes means for delivering a series of closely spaced individual flexible products to a transfer point, with a spacing therebetween of typically less than about ½ inch, and means positioned at the transfer point for transferring said flexible products to a delivery point while maintaining substantially the same spacing between the products. The means at the transfer point include a vacuum transfer drum having a plurality of annular grooves about the periphery thereof, and means for rotating the drum.

Adjacent the transfer drum is an orbital packer mechanism including a shaft mounted adjacent the transfer drum for orbital movement, drive means for orbiting the shaft, and a plurality of packer fingers secured to the shaft and extending into the annular grooves for removing the flexible products sequentially from the transfer drum and delivering them to the delivery point.

The vacuum transfer drum includes a vacuum source, and a plurality of vacuum ports about the outer periphery of the transfer drum. Communicating with the vacuum source, a series of vacuum ports are arrayed across the transfer drum surface to secure associated leading edges of the flexible products to the outer surface of the transfer drum. To insure proper transfer, the vacuum at each successive series of ports is terminated at a point where the fingers come in to contact across substantially the full width of the flexible products.

This embodiment of the invention may also include means for adjusting the pick off position of the packer fingers relative to the transfer drum while the apparatus is in operation. This means for adjusting the pick off position may comprise a phaser and also includes mean for adjusting the output of the phaser to control the orbiting of the orbital packer shaft and, thus, the positioning of the packer fingers. In this manner, the timing between the orbital packer fingers and rotating transfer drum may be precisely controlled while the apparatus is in operation to insure that the packer fingers do not contact succeeding bags on the transfer drum.

In still another embodiment of the invention, an apparatus for the sequential handling and delivery of individual flexible products is provided and includes means for delivering a series of closely spaced individual flexible products to a transfer point. Means are positioned at the transfer point for transferring the flexible products to a delivery point while maintaining substantially the same spacing between the products. The transfer means include a vacuum transfer drum having a plurality of annular grooves about the periphery thereof, and means for rotating the drum.

A shaft is mounted adjacent the transfer drum for orbital movement and includes drive means for orbiting the shaft. A plurality of fingers are secured to the shaft and extend into the annular grooves for removing the flexible products sequentially from the transfer drum and delivering them to the delivery point. The apparatus also includes means for stacking the individual flexible products and means for separating a predetermined number of the individual flexible products from the stack.

Additionally, the apparatus includes means for adjusting the timing between the separation of the predetermined number of flexible products from the stack and the removal of the flexible products from the transfer drum by the packer fingers. The means for adjusting the timing comprise a phaser having an output for driving the means for separating the individual flexible products from the stack to control the timing thereof. The ability to control the timing while the apparatus is in operation reduces the potential for machine jams, stacking problems, and down time as minor adjustments may be made as needed. The means for separating a predetermined number of the individual flexible products from the stack preferably comprise count fingers movable from a position adjacent the stack of individual flexible products to a position separating the stack into a predetermined number of individual flexible products.

Accordingly, it is an object of the present invention to provide a method and apparatus for the sequential handling and delivery of individual flexible products, such as plastic bags or containers, which enables the use of extended length orbital packer fingers for removing closely spaced flexible products from a transfer drum. It is a further object of the present invention to provide a method and apparatus which prevent horizontal acceleration of the flexible products as they are delivered and stacked. It is yet another object of the present invention to provide a method and apparatus to adjust precisely the timing for the packer and count fingers and vacuum transfer mechanisms in a device for the sequential handling of individual flexible products so that machine jams and stacking problems are reduced. These, and other objects and advantages of the present invention, will become apparent from the following detailed description, the accompanying drawings, and the appended claims.

BRIEF DESCRIPTION OF THE DRAWINGS

FIG. 11 is a top plan view taken along line 11—11 in FIG. 8:

FIG. 12 is an enlarged top plan view of the counter mechanism shown in FIG. 11:

FIG. 13 is a front plan view taken along line 13—13 in FIG. 11:

DETAILED DESCRIPTION OF THE PREFERRED EMBODIMENTS

Figure 1:
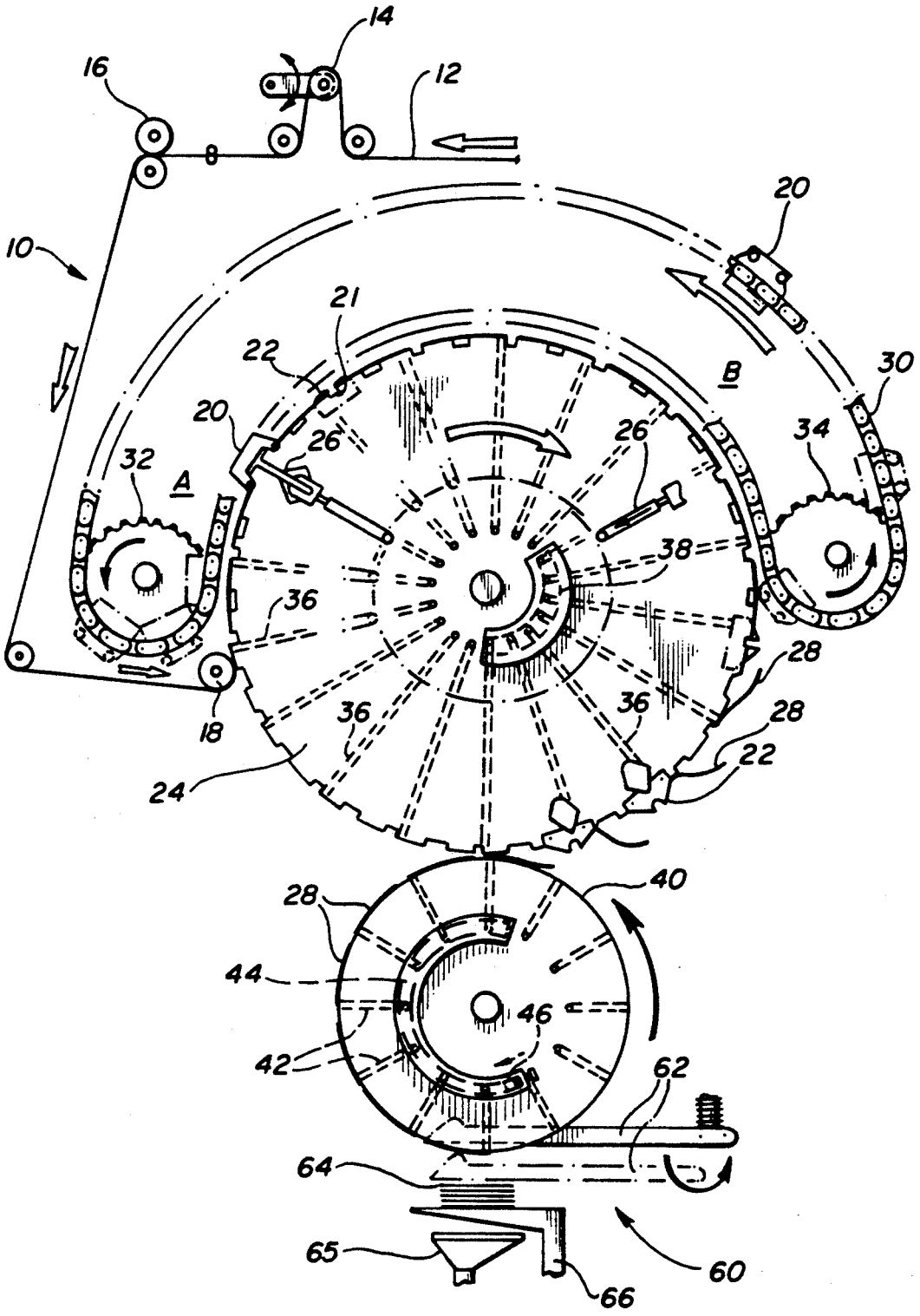
FIG. 1 is a schematic side elevational view of the sequential handling and delivery system of the present invention.

Referring now to FIG. 1, one embodiment of the sequential product handling and delivery system of the present invention is illustrated in schematic form. Handling and delivery system 10 receives a continuous web, designated film web 12, from a spool (not shown) or directly from an extrusion line. While the invention will be described in the context of a web of thermoplastic material used to form individual plastic bags or containers, it will be apparent to those skilled in the art that the delivery system of the present invention is applicable to other products which are fed from a continuous web and then divided into a series of closely spaced individual flexible products. By closely spaced, we mean products which typically are spaced less than about ½ inch apart, and most typically have a spacing between products of from about ⅛ to ½ inch.

Film web 12 may either be a zippered or unzippered bag stock being folded on itself to provide a two ply film. Film web 12 is caused to pass over dancer roll 14 which acts to control film web tension based on its vertical positioning. Film web 12 is then pulled through a draw roll arrangement 16 which is driven at a speed slightly in excess of the rotational speed of product drum 24. This type of operation permits some slack in the film as it is being fed onto vacuum product drum 24. Vacuum product drum 24 is driven by drive means (not shown) in a conventional manner. The film web 12 then passes over a lay-on roll 18 which is located to position the film web accurately against the rotating product drum surface.

Film web 12 is then severed and sealed on product drum 24 in the following manner. Film web 12 is clamped tightly to the outer surface of product drum 24 at a severing and sealing edge of a heating element slot 21 by seal bar assembly 20. Seal bar assembly 20 is aligned in proper position through the use of yokes 22 on the product drum 24. As product drum 24 rotates in the direction of the arrow, a heated wire severing and sealing element, shown generally at 26, operable through a cam assembly (not shown), emerges from a recess in product drum 24 and severs film web 12 at position A. The severing and sealing element remains extended for approximately 120 degrees of rotation of the product drum until the severing and sealing element 26 is withdrawn as shown schematically at position B. During the time that the element is extended, the film melts back to the edge of the seal bar assembly 20 and a bead seal forms on the edge of the bag. This melt back of the thermoplastic film results in less than an approximately ½ inch spacing between adjacent bags on product drum 24, and typically an approximately ⅛ to ½ inch spacing. The spacing further aids in preventing adjacent bags from touching and resealing to each other. Individual bags 28 are formed by the severing and sealing of the film web on adjacent seal bar assemblies.

Just prior to the release of the clamping force of the seal bar assembly 20, a vacuum is applied to the leading edge of individual bags 28. Seal bar assembly 20 is removed from the product drum by a continuous chain drive 30 having sprockets 32 and 34 located on opposite sides of product drum 24. The chain drive permits precise positioning of the individual seal bar assemblies 20 along the surface of the product drum.

Individual bags 28 are held in position on rotating product drum 20 by respective vacuum ports 36 which communicate with a central manifold 38, which in turn communicates with a vacuum source (not shown). Each port 36, as shown, represents a series of vacuum ports arrayed across the surface of drum 24 parallel to the rotational axis of the drum so that multiple individual ports hold bags 28 in position. As shown, as product drum 24 rotates, vacuum ports 36 are brought into and out of communication with manifold 38. This construction causes a vacuum to be applied to the leading edges of bags 28 beginning at a point just prior to the removal of seal bar assembly 20 until just prior to transfer to transfer drum 40.

Bags 28 are held onto rotating transfer drum 40 by a similar vacuum system. Vacuum ports 42 communicate with a central manifold 44, which in turn communicates with a vacuum source (not shown). Again, each port 42, as shown, represents a series of vacuum ports arrayed across the surface of drum 40. As shown, at a point approximately along a line between the centers of product drum 24 and transfer drum 40, the vacuum is relieved from product drum 24. Gravity then causes the bags 28 to fall toward drum 40 where a corresponding vacuum port 42 is activated.

The vacuum ports 42 on transfer drum 40 are positioned so that each as individual bag 28 is removed from the product drum it is held on the surface of transfer drum 40 by a corresponding series of vacuum ports 42 arrayed across the drum surface. As shown, each series of vacuum ports is active during rotation of transfer drum 40 until a point just past vertical alignment with packing device 60 and just as orbital packer fingers 62 come fully into contact across substantially the full width of bags 28. As bags 28 are brought around transfer drum 40, the vacuum through vacuum ports 42 hold onto the bags until they reach this position where the vacuum is released. Means, such a movable slug 46, are mounted in manifold 44 so that the precise cut off point where the vacuum is terminated may be adjusted while the apparatus is in operation, as explained in greater detail below.

Figure 15:
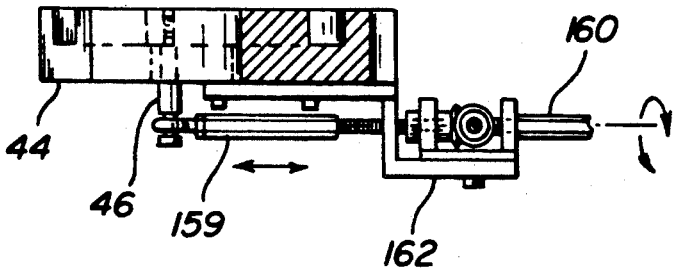
FIG. 15 is a top plan view taken along line 15—15 in FIG. 14.
Figure 14:
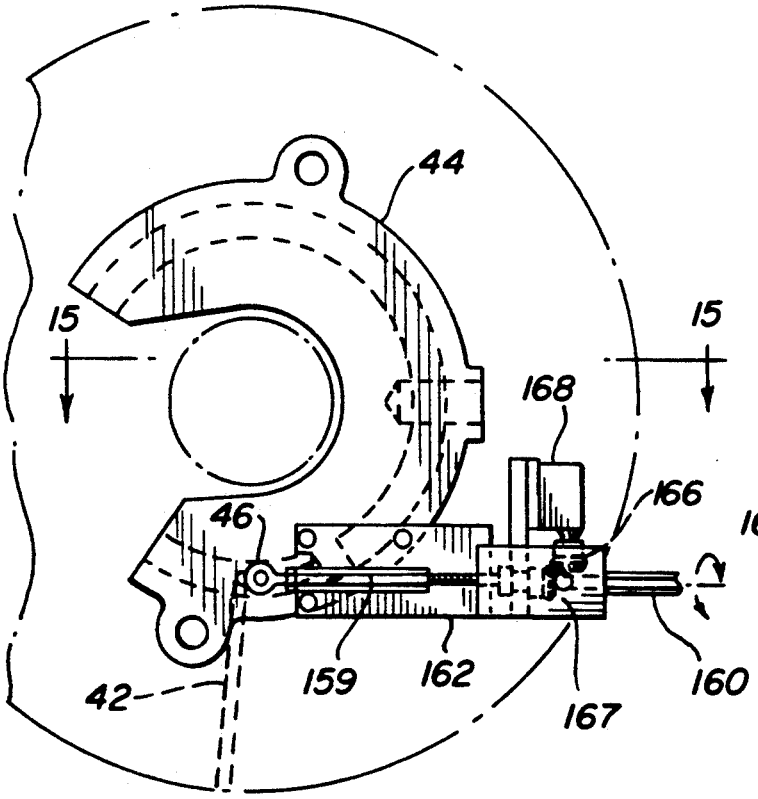
FIG. 14 is a front plan view of a preferred vacuum adjustment mechanism for the vacuum manifold on the transfer drum.
Figure 16:
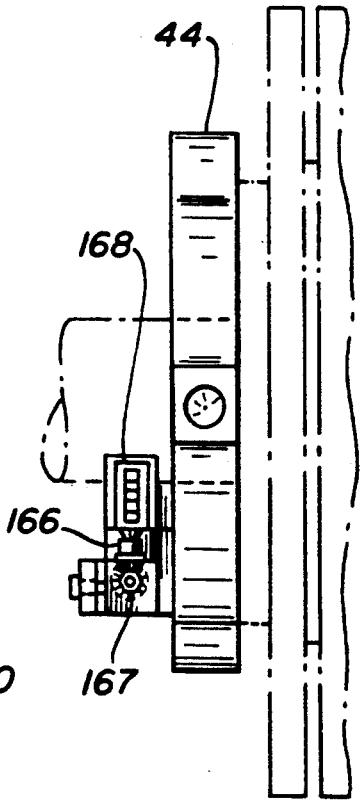
FIG. 16 is a side plan view of the vacuum adjustment mechanism of FIG. 14.

As illustrated in greater detail in FIGS. 14–16, the positioning of slug 46 in relation to the pick off point for bags 28 from vacuum ports 42, may be adjusted using an adjusting rod 160 mounted within bracket 162. Rod 160 is threaded so that rotation of the rod in a clockwise direction advances the vacuum release timing by moving a hexagonally-shaped turnbuckle 159 which extends or retracts slug 46 further forward on central manifold 44. This positioning of vacuum slug 46 causes it to cover each succeeding vacuum port 42 sooner as drum 40 rotates so that the vacuum to each port is cut off sooner. For example, as illustrated in FIG. 14, the positioning of slug 46 will cause vacuum to port 42 to be cut off just as that port reaches a vertical orientation (just as the leading edge of bag 28 reaches its lowest point as drum 40 rotates). Conversely, by turning adjusting rod 160 counterclockwise, the vacuum release timing of the bags will be retarded, as the vacuum ports will be in communication with the vacuum source for a greater period. By "vacuum release", we mean the point at which the vacuum to a port 42 is terminated.

To provide an indication of the degree of advancement or retardation of the vacuum release timing, a first gear 166 is engaged with a second gear 167 on rod 160 to display an output on digital counter 168. By providing a rod with a known number of threads per inch, the amount of movement of slug 46, as displayed on counter 168, will be known and can be adjusted, as necessary, even when the apparatus is in operation. The use of an external, accessible adjustment which provides an indication of positioning to the machine operator provides significant advantages over prior art trial and error adjustments which could be carried out only when the apparatus was shut down.

In packing device 60, orbital packer fingers 62 pull the individual bags 28 away from the transfer drum surface and deposit the bags into a stack 64 on delivery table 65. As shown by the phantom lines, as well as by the views in FIGS. 4–6, fingers 62 preferably extend and contact across substantially the full width of bags 28 as the bags are removed from drum 40. However, the timing and adjustment devices of the present invention are also useful when operated in conjunction with an apparatus equipped with conventional, shorter length packer fingers. The surface of fingers 62 which contact bags 28 may be specially treated or finished to provide a high degree of friction during the time when bags 28 are moving at a high velocity relative to the finger surface. This high degree of friction will tend to decelerate the bags as they are stacked on table 65.

At a precise time, count fingers 66 pivot between the position shown in phantom lines completely out of the stream of bags into the position shown to separate the stack 64 of bags into the desired count. The delivery table 65 may be lowered to permit a clamp assembly (not shown) to clamp the stack of bags and transfer it to further conventional equipment for packaging the bags.

Figure 2:
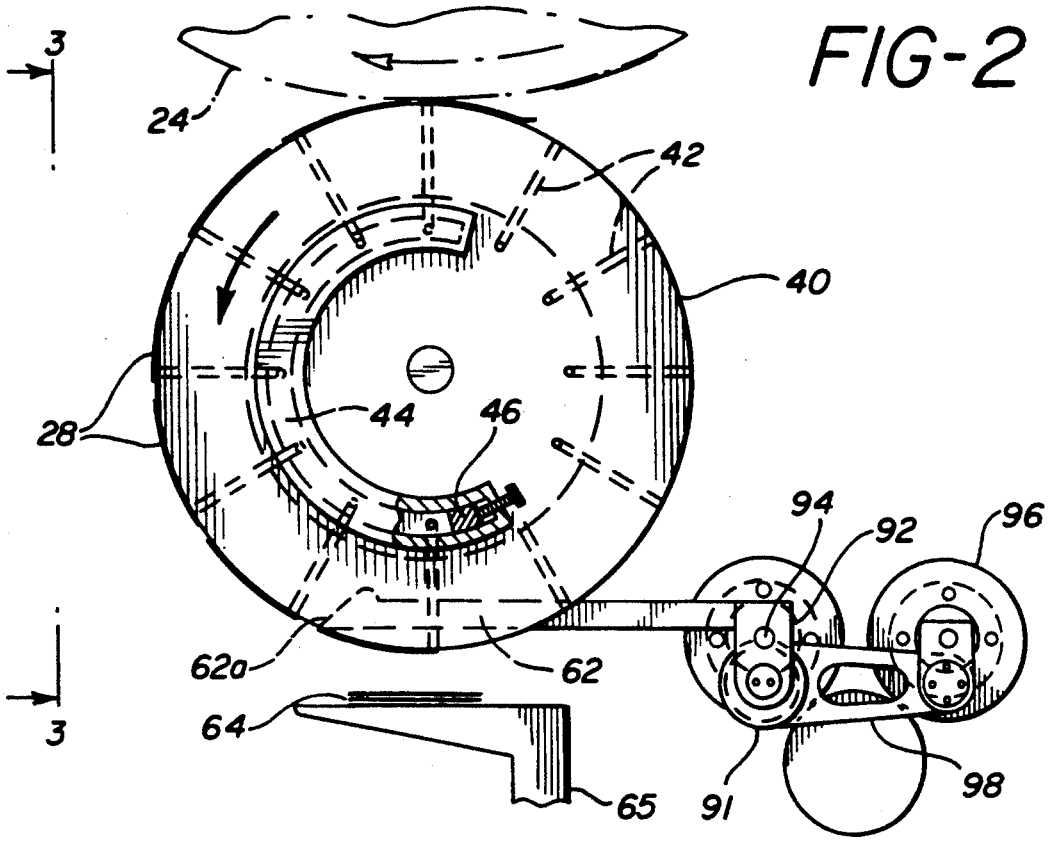
FIG. 2 is an enlarged side elevational view of the transfer drum of FIG. 1 with packer fingers fully extended and showing details of the orbital mechanism.
Figure 3:
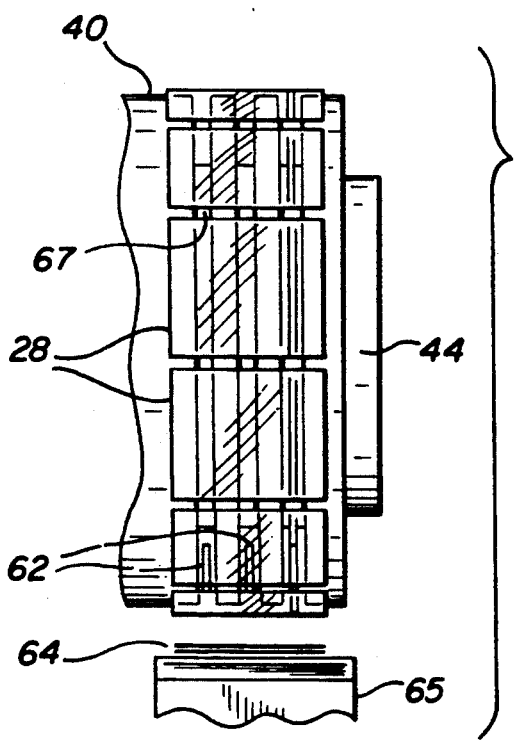
FIG. 3 is an enlarged front elevational view taken along line 3—3 in FIG. 2 illustrating the packer fingers within the annular grooves in the drum.

The positioning and operation of packer fingers 62 is shown in FIGS. 2 and 3. As illustrated, a series of packer fingers 62 extend inwardly substantially normal to the axis of rotation of transfer drum 40 into a corresponding series of annular grooves 67 extending around the surface of the transfer drum. Preferably, the length of the fingers is such that when they fully engage the product bags 28, the ends of the fingers extend substantially across the full radial width of bags 28 as the bags are stripped from drum 40. Such full contact by the packer fingers prevents bag fold over problems as the bags are removed from the drum and stacked. Also illustrated are the angled tips 62*a* of fingers 62. The tips 62*a* preferably are angled at an acute angle, and most preferably at an angle of less than about 45 degrees, to aid in clearing the leading edges of succeeding bags 28 as the fingers complete their orbit and return.

Figure 8:
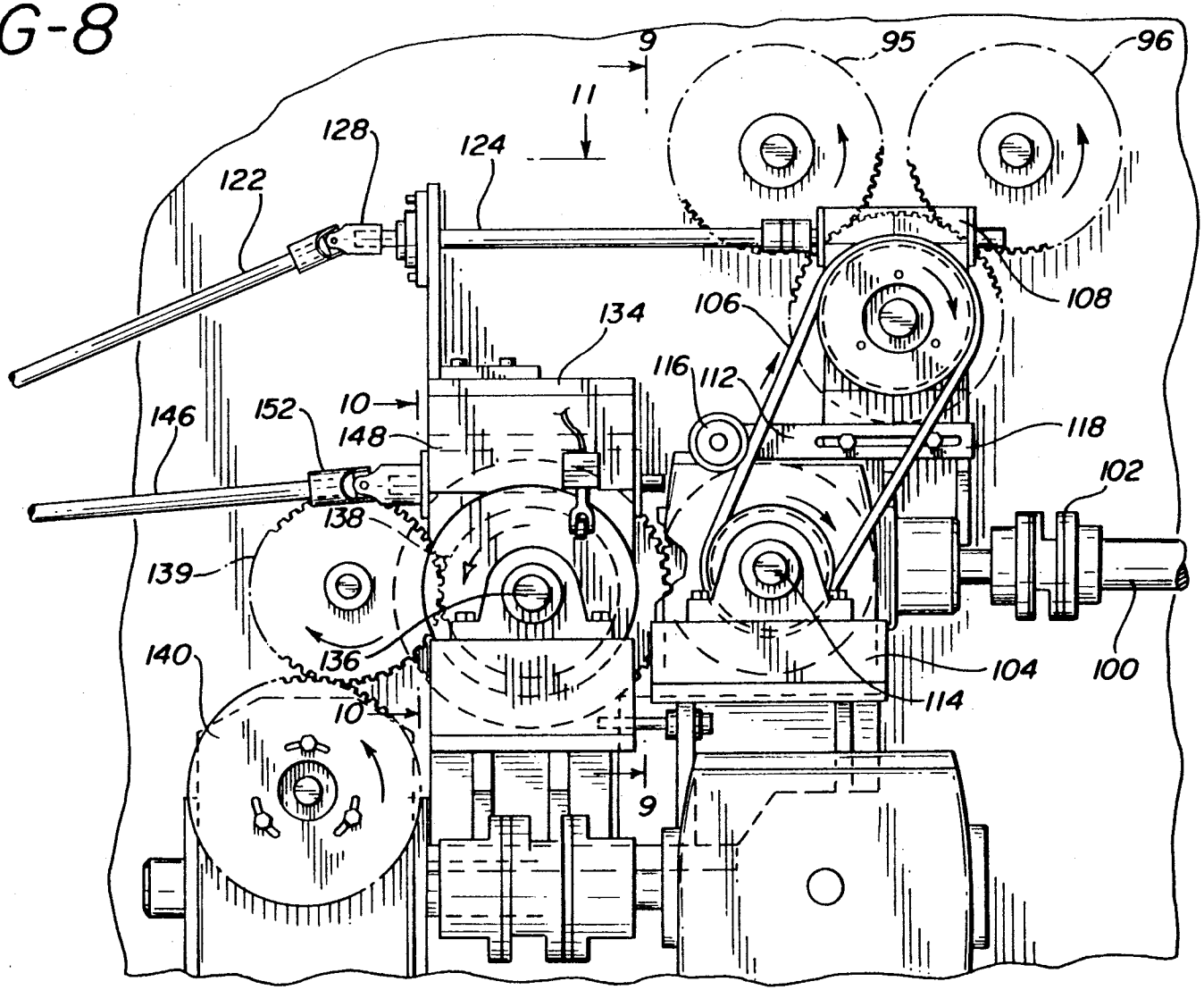
FIG. 8 is a side plan view of the drive apparatus for the orbital packer mechanism, showing the phase adjustment and control device.

Also illustrated in FIG. 2 are portions of the orbital packing machinery for driving the fingers. The operation of the fingers is in a generally circular orbit. However, other configurations such as an elliptical orbit may be utilized. A tube 91, which extends transversely of the packing machine, is equipped with a bracket 92 which carries packer fingers 62. Tube 91 is connected at each of its ends to a first gear 95 (see FIG. 8) which is carried on rotating shaft 94. Tube 91 is also connected to a second gear 96 by means of a connecting bar 98. Shafts 94 and 97 are driven by suitable drive means (See FIG. 8). The construction and operation of the orbital packing machinery is described in greater detail in U.S. Pat. No. 3,640,050, the disclosure of which is incorporated by reference.

Figure 4:
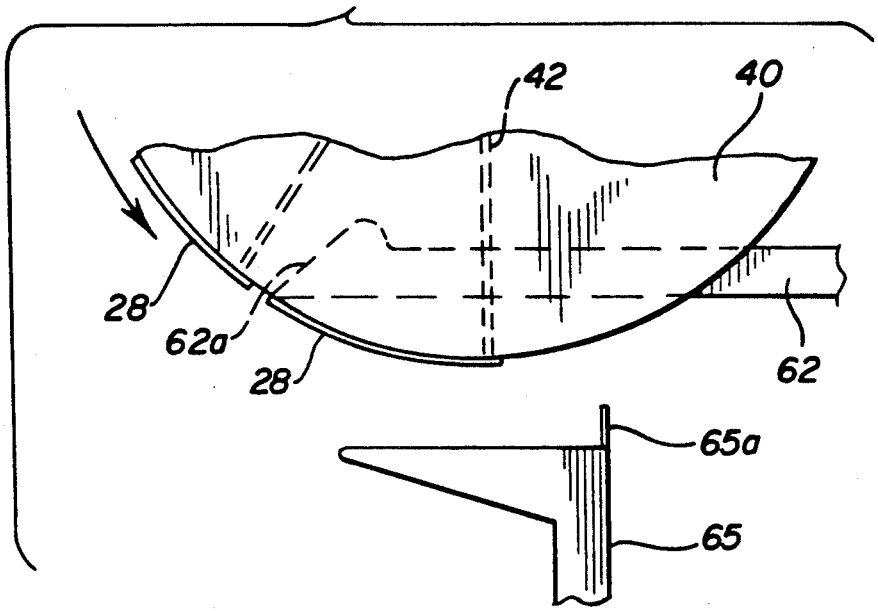
FIG. 4 is an enlarged side elevational view of the transfer drum of FIG. 1 with packer fingers extending across substantially the entire bag surface and contacting the trailing edge of a bag.

Referring now to FIGS. 4–7, the operation of the packer fingers 62 is shown and explained in greater detail. As shown in FIG. 4, the orbit of packer fingers 62 has positioned the fingers within grooves 67 (shown in FIG. 3) and has positioned tips 62*a* to contact the trailing edge of bag 28 carried on transfer drum 40. At this point, the packer fingers are approximately 60 degrees from the top dead center of their orbit. Only the leading edge of bag 28 is secured by vacuum; however, the rotation of drum 40 and static forces combine to maintain bags 28 substantially flat against the surface of drum 40.

Figure 5:
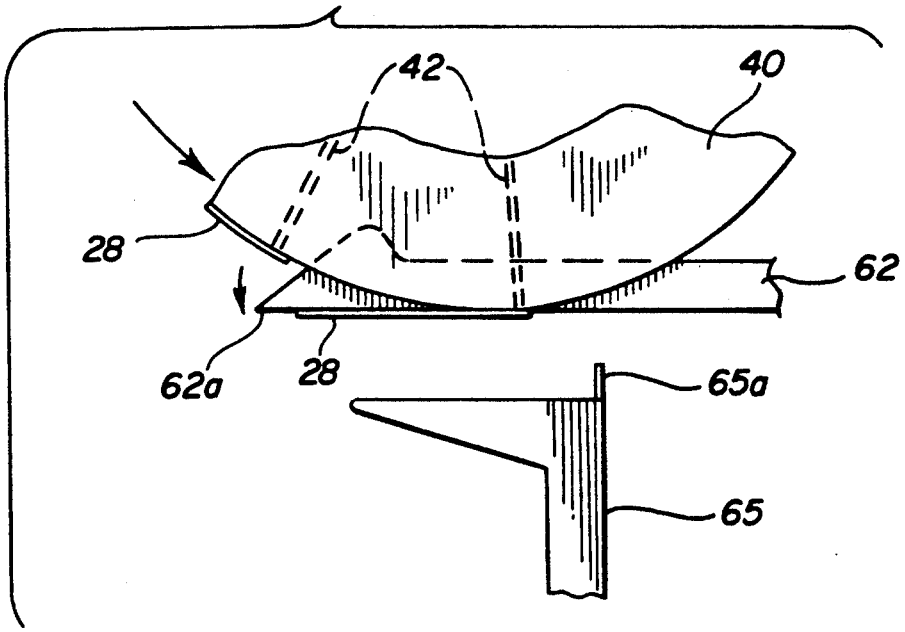
FIG. 5 is an enlarged side elevational view of the transfer drum of FIG. 1 with packer fingers extending across substantially the entire bag surface and contacting substantially the entire surface of the bag just as it is to be picked off of the transfer drum.

As shown in FIG. 5, the taper on tips 62*a* permits them to just miss the next succeeding bag 28 as the orbit of the packer fingers moves them downward toward stacking table 65. The respective leading and trailing edges of successive bags are separated only slightly on drum 40. Typically, the distance of separation is less than about ½ inch, and maybe between about ⅛ to ½ inch. This separation is the result of the slight melt back of the thermoplastic bag material when it was severed and sealed on the product drum.

In FIG. 5, packer fingers 62 are shown extending and contacting across substantially the full width of bag 28 at the point where bag 28 is removed from drum 40. As previously discussed, the vacuum in port 42 is released just at this point by adjusting the position of movable slug 46 in vacuum manifold 44. As can be seen, the trailing edge of bag 28 is held against packer fingers 62 to prevent any curling or folding of the bag edge as it is pulled downwardly toward stacking table 65. At this point, the packer fingers are approximately 80 degrees from bottom dead center of their orbit.

In prior art apparatuses, the trailing edges of the bags were not in contact with the packer fingers and had a tendency to curl or fold as they were stacked. This sometimes resulted in stacking and misalignment problems which caused machine jamming or improper loading of the bags into packaging. The apparatus and method of the present invention prevents bag curl or fold over by extending the packer fingers to extend substantially across the entire width of bags 28.

Figure 6:
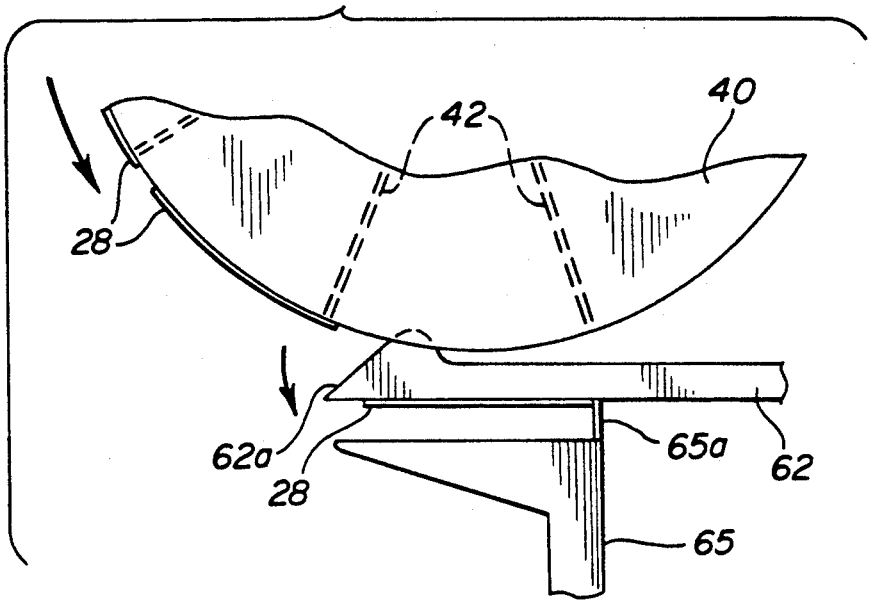
FIG. 6 is an enlarged side elevational view of the transfer drum of FIG. 1 with the packer fingers at bottom dead center of their orbit and the leading edge of the bag just striking the backstop on the stacking table.

Referring now to FIG. 6, bag 28 has been removed from drum 40 and has been pulled downwardly toward stacking table 65 by packer fingers 62. The leading edge of bag 28 is just contacting backstop 65a. At this point, packer fingers 62 are at bottom dead center of their orbit. In prior art apparatuses, the timing of the packer fingers was such that the leading edges of the bags contacted the backstop on the stacking table before the fingers reached bottom dead center of their orbit. This resulted in the fingers continuing to push downwardly on the bags, as well as dragging the bags toward the backstop, sometimes resulting in the crumpling of the bags against the backstop or the bouncing of the bags against and then away from the backstop. Both were undesirable.

Figure 7:
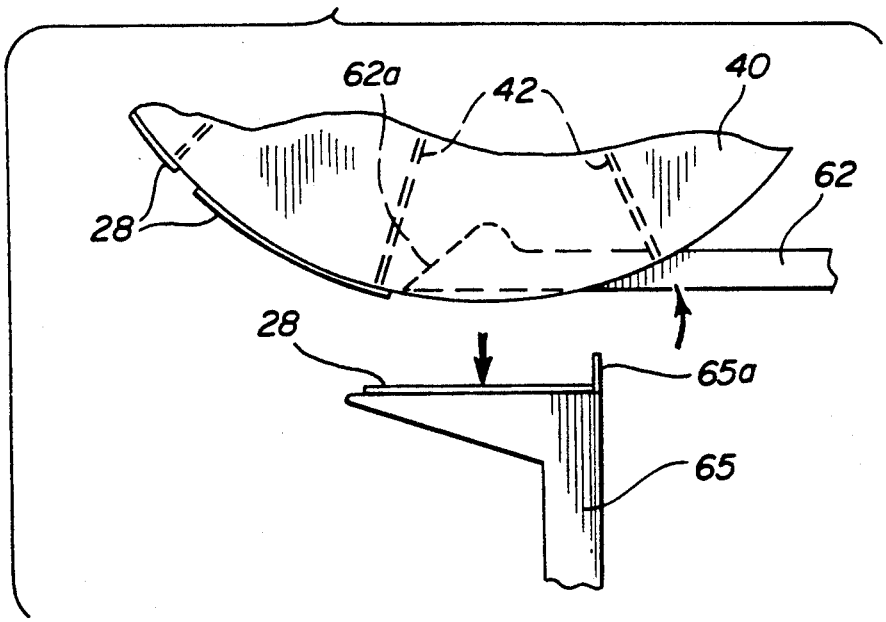
FIG. 7 is an enlarged side elevational view of the transfer drum of FIG. 1 with the packer fingers approximately 90 degrees past bottom dead center and the tips of the packer fingers just clearing the leading edge of the next bag.

The method and apparatus of the present invention has advanced the timing of the packer fingers so that the fingers reach bottom dead center of their orbit and then begin to move up as the leading edge of the bag contacts the backstop. This results in the prevention of bag crumpling and bounce. Finally, as shown in FIG. 7, packer fingers 62 orbit upwardly, with tips 62a just clearing the leading edge of the next succeeding bag before beginning a new orbit.

To obtain precise control of the timing of the orbital packer fingers 62, which strip bags 28 from transfer drum 40, the apparatus of the present invention includes means for adjusting the timing of the packer fingers relative to transfer drum 40. Additionally, to obtain the same precise control of the count fingers 66, which fire into the stack of bags 28 on delivery table 65, the apparatus of the present invention includes means for adjusting the timing of the count finger "dive" into the stack of bags relative to the orbital packer fingers.

Referring now to FIGS. 8–13, the drive assembly for the orbital packing device 60 is shown. Power from a main drive shaft 100 is used to drive orbital packer 60 indirectly through coupling 102, reducer gear box 104 and heavy duty timing belt 106. Timing belt 106 drives phaser 108, which in turn drives orbital packer drive shaft 109 and gears 95, 96 (see FIG. 2). Further, gear box 104 also drives the front end of the apparatus, including the count fingers, through gears 138, 139, and 140 via drive shaft 114.

Figure 9:
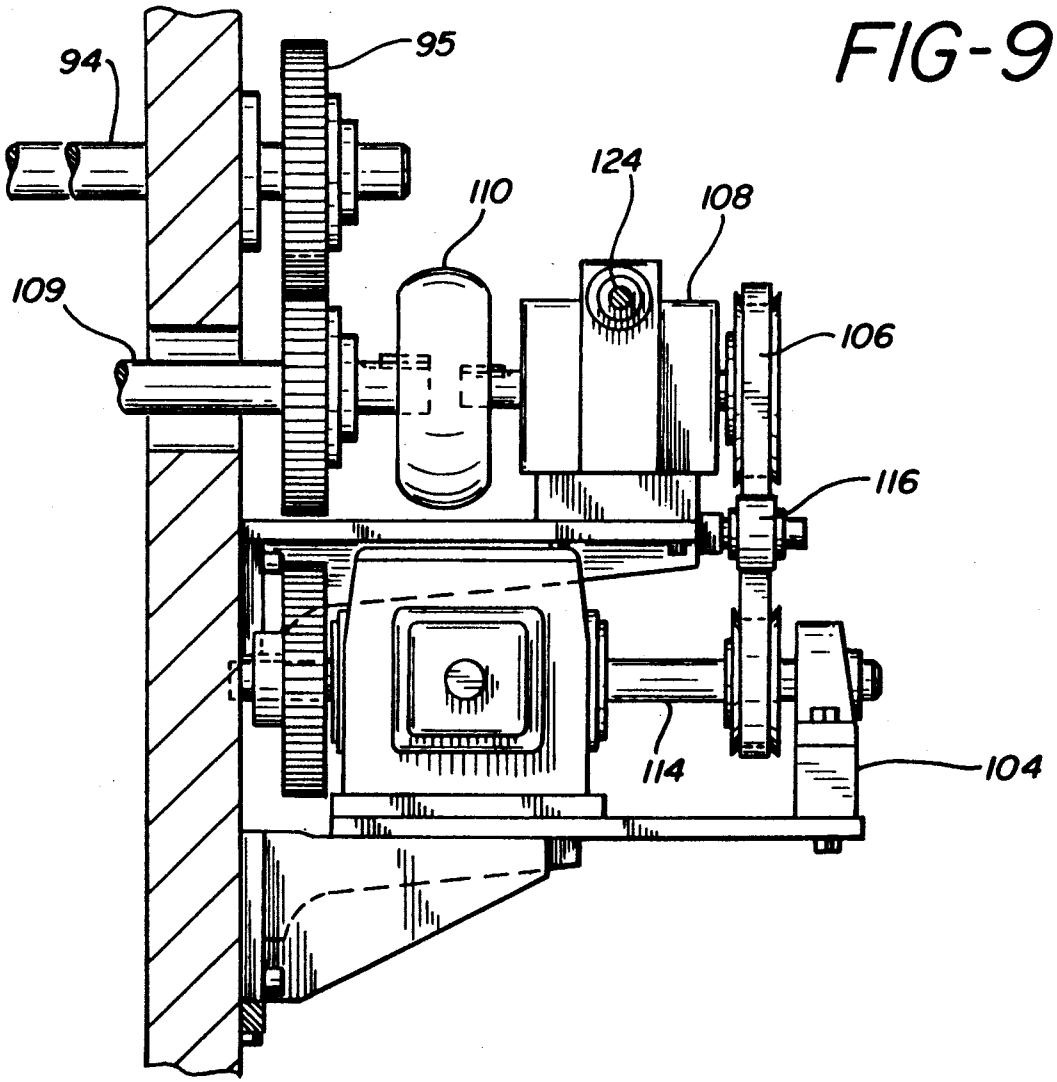
FIG. 9 is an end plan view taken along line 9—9 in FIG. 8.
Figure 10:
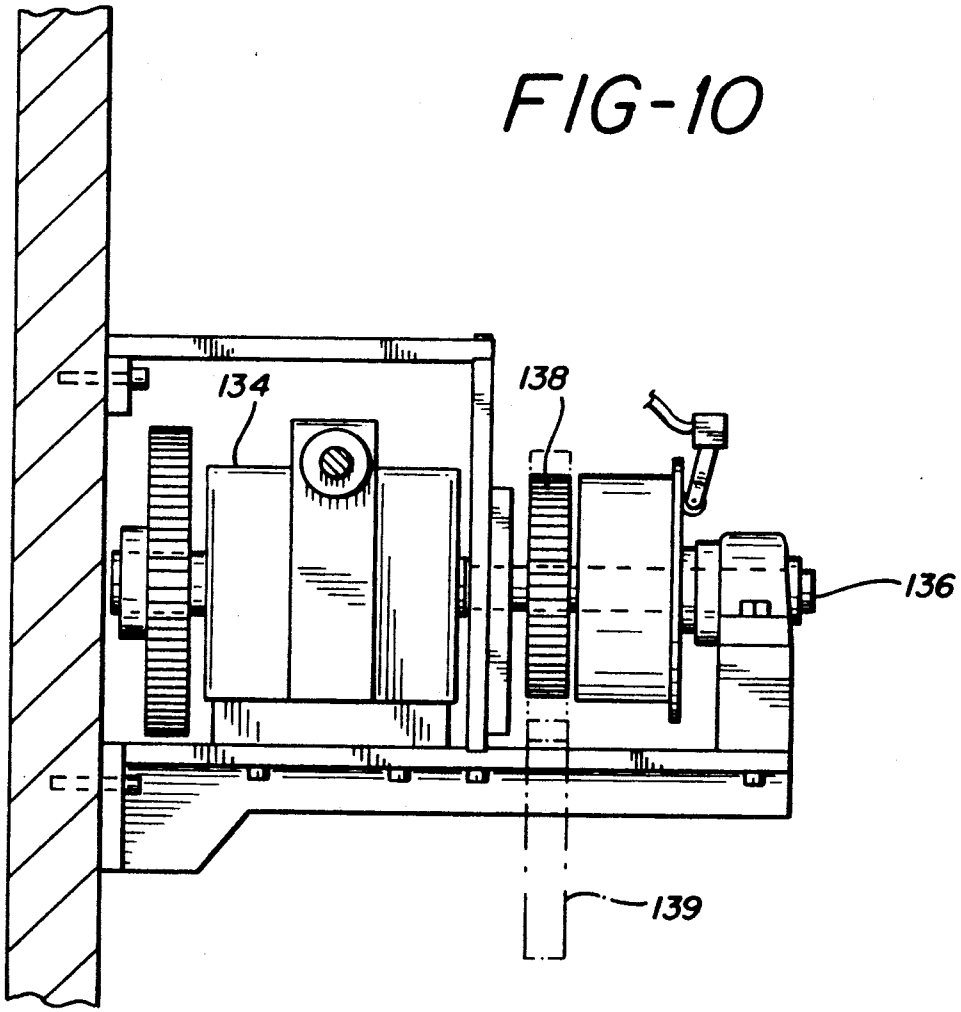
FIG. 10 is an end plan view taken along line 10—10 in FIG. 8.

As best shown in FIG. 9, phaser 108 is located in-line with orbital packer drive shaft 109, and is connected to shaft 109 with a flexible coupling 110. Timing belt 106 and tensioning device 112 connect the phaser 108 to the reducer gear box shaft 114. The phaser 108 is designed so that it makes exactly one rotation of 360° for each bag 28 removed by orbital packer 60. Tensioning device 112 includes an idler pulley 116 mounted on tensioner bracket 118.

Phaser 108, which may be a Fairchild FHT-A1 differential transmission available from Fairchild Industrial Products Company, permits the precise adjustment of the pick off position of packer fingers 62 relative to transfer drum 40 while the apparatus is in operation. As practiced by the present invention, this adjustment is made by turning hand wheel 118 either clockwise to advance the timing or counterclockwise to retard the timing of orbital packer 60 and packer fingers 62. As best shown in FIGS. 11–13, hand wheel 118 is connected, through correction shafts 120, 122, and 124, and universal joints 126, 128, to phaser 108.

Hand wheel 118 is also connected, through gears 130 and 131, to a digital counter 132. By maintaining a proper gear ratio between hand wheel 118 and counter 132, an operator of the device may maintain precise control over the packer finger timing. For example, the gear ratio may be chosen so that for every one digit change on the counter, the packer finger timing is adjusted by 0.1°. Thus, to advance the packer finger timing by 1.0°, the hand wheel would be turned clockwise to raise the counter reading by 10 digits. Likewise, to retard the packer finger timing by 1.0°, the hand wheel would be turned counterclockwise to lower the counter reading by 10 digits.

Because of the longer packer fingers which may be employed in the practice of the present invention, this precise control of timing is important. By using the apparatus of the present invention, the packer finger timing may be controlled to within +/−0.1° of rotation while the machine is in operation. This contrasts to prior art machines in which the timing could only be adjusted laboriously by hand to within 2°–3° of packer rotation while the machine was shut down.

To control precisely the timing of the count fingers 66, the apparatus of the present invention also includes a second phaser 134 which is driven in conjunction with phaser 108. The output drive shaft 136 of phaser 134 drives the front end of the apparatus including quadrant gear 138, gear 139, and count gear 140. Count gear 140, in turn, controls the timing of count fingers 66 as they dive into a stack of bags 28 at the proper time. Thus, phaser 134 enables precise control of the timing of count fingers 66 in relation to the orbital packer fingers 62.

As shown in FIGS. 8 and 10–13, the timing of the count fingers through second phaser 134 is effected by turning hand wheel 142, which is connected to phaser 134 through correction shafts 144, 146, and 148, and flexible universal joints 150, 152. Hand wheel 142 is also connected, through gears 154 and 155, to a second digital counter 156. By maintaining a known gear ratio between hand wheel 142 and counter 156, an operator of the device may maintain precise control over the count finger timing. For example, the gear ratio may be chosen so that for every one digit change on the counter, the count finger timing is adjusted by 0.1° relative to a single bag. Thus, to advance the count finger timing by 1.0°, the hand wheel would be turned counterclockwise to raise the counter reading by 10 digits. Likewise, to retard the count finger timing by 1.0°, the hand wheel would be turned clockwise to lower the counter reading by 10 digits.

The present invention permits this precise adjustment while the apparatus is in operation. This contrasts with prior art machinery which required laborious trial and error adjustments with the machinery shut down.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. An apparatus for the sequential handling and delivery of individual flexible products comprising:

means for delivering a series of closely spaced individual flexible products to a transfer point:

means positioned at said transfer point for transferring said flexible products to a delivery point while maintaining substantially the same spacing between said products, said means including a vacuum transfer drum having a plurality of annular grooves about the periphery thereof, and means for rotating said drum;

a shaft mounted adjacent said transfer drum for orbital movement, including drive means for orbiting said shaft; and a plurality of fingers secured to said shaft and extending into said annular grooves for removing said flexible products sequentially from said transfer drum and delivering them to said delivery point, said fingers extending and contacting across substantially the full width of said flexible products as said products are removed from said transfer drum.

2. The apparatus of claim 1 in which said vacuum transfer drum includes a vacuum source, and a plurality of vacuum ports about the outer periphery of said transfer drum and communicating with said vacuum source for securing the leading edges of said flexible products to the outer surface of said transfer drum.

3. The apparatus of claim 2 including a series of vacuum ports arrayed across the transfer drum surface associated with respective leading edges of said flexible products, and means for adjusting the point at which the vacuum at each successive series of ports is terminated, said adjusting means being capable of operation during operation of said apparatus.

4. The apparatus of claim 1 including means for stacking said individual flexible products.

5. The apparatus of claim 4 in which said stacking means includes means for halting the horizontal movement of said flexible products.

6. The apparatus of claim 5 in which said halting means include a back stop.

7. The apparatus of claim 5 in which the orbit of said fingers is at bottom dead center when said individual flexible products reach said halting means.

8. The apparatus of claim 1 including means for adjusting the pick off position of said fingers relative to said transfer drum.

9. The apparatus of claim 8 in which said means for adjusting the pick off position comprise a phaser, and means for adjusting the output of said phaser to control the orbiting of said shaft and the positioning of said fingers.

10. The apparatus of claim 8 in which said means for adjusting the output of said phaser include a hand wheel connected to said phaser.

11. A method for the sequential handling and delivery of individual flexible products comprising the steps of:

delivering a series of closely spaced individual flexible products to a transfer point;

transferring said flexible products from said transfer point to a delivery point while maintaining substantially the same spacing between said products by transferring said flexible products onto a rotating vacuum transfer drum having a plurality of annular grooves about the periphery thereof;

removing said flexible products sequentially from said transfer drum and delivering them to said delivery point using a plurality of fingers which extend into said annular grooves and remove said flexible products sequentially from said transfer drum and deliver them to said delivery point, said fingers extending and contacting across substantially the full width of said flexible products as said products are removed from said transfer drum.

12. The method of claim 11 in which the leading edges of said flexible products are secured to the outer surface of said transfer drum by vacuum, and said vacuum on said leading edges of said flexible products is released at the point at which said fingers contact across substantially the full width of said flexible products.

13. The method of claim 12 including the step of stacking said flexible products as said products are removed from said transfer drum.

14. The method of claim 13 in which said flexible products are stacked against a back stop.

15. The method of claim 13 in which the orbit of said fingers reaches bottom dead center as said leading edges of said flexible products contacts said back stop.

16. A method for the sequential handling and delivery of individual flexible products comprising the steps of:

delivering a series of closely spaced individual flexible products to a transfer point;

transferring said flexible products from said transfer point to a delivery point by transferring said flexible products onto a rotating vacuum transfer drum having a plurality of annular grooves about the periphery thereof:

removing said flexible products sequentially from said transfer drum and delivering them to said delivery point using a plurality of fingers which extend into said annular grooves and remove said flexible products sequentially from said transfer drum and deliver them to said delivery point, the orbit of said fingers reaching bottom dead center as said leading edges of said flexible products contact said backstop.

17. An apparatus for the sequential handling and delivery of individual flexible products comprising:

means for delivering a series of closely spaced individual flexible products to a transfer point:

means positioned at said transfer point for transferring said flexible products to a delivery point while maintaining substantially the same spacing between said products, said means including a vacuum transfer drum having a plurality of annular grooves about the periphery thereof, and means for rotating said drum;

a shaft mounted adjacent said transfer drum for orbital movement, including drive means for orbiting said shaft; and a plurality of fingers secured to said shaft and extending into said annular grooves for removing said flexible products sequentially from said transfer drum and delivering them to said delivery point; and means for adjusting the pick off position of said fingers relative to said transfer drum, said means for adjusting the pick off position comprising a phaser, and means for adjusting the output of said phaser to control the orbiting of said shaft and the positioning of said fingers.

18. The apparatus of claim 17 in which said means for adjusting the output of said phaser include a hand wheel connected to said phaser.

19. The apparatus of claim 17 in which said vacuum transfer drum includes a vacuum source, and a plurality of vacuum ports about the outer periphery of said transfer drum and communicating with said vacuum source for securing the leading edges of said flexible products to the outer surface of said transfer drum.

20. The apparatus of claim 19 including a series of vacuum ports arrayed across the transfer drum surface associated with respective leading edges of said flexible products, and means for adjusting the point at which the vacuum at each successive series of ports is terminated, said adjusting means being capable of operation during operation of said apparatus.

21. The apparatus of claim 17 including means for stacking said individual flexible products.

22. The apparatus of claim 21 in which said stacking means includes means for halting the horizontal movement of said flexible products.

23. The apparatus of claim 22 in which said halting means include a back stop.

24. The apparatus of claim 22 in which the orbit of said fingers is at bottom dead center when said individual flexible products reach said halting means.

25. An apparatus for the sequential handling and delivery of individual flexible products comprising:

means for delivering a series of closely spaced individual flexible products to a transfer point;

means positioned at said transfer point for transferring said flexible products to a delivery point while maintaining substantially the same spacing between said products, said means including a vacuum transfer drum having a plurality of annular grooves about the periphery thereof, and means for rotating said drum;

a shaft mounted adjacent said transfer drum for orbital movement, including drive means for orbiting said shaft: and a plurality of fingers secured to said shaft and extending into said annular grooves for removing said flexible products sequentially from said transfer drum and delivering them to said delivery point;

means for stacking said individual flexible products;

means for separating a predetermined number of said individual flexible products from the stack: and means for adjusting the timing between the removal of said predetermined number of flexible products from said stack and the removal of said flexible products from said transfer drum by said fingers, said means for adjusting the timing comprising a phaser having an output for driving said means for separating said individual flexible products.

26. The apparatus of claim 25 in which the output from said phaser is controlled by operation of a hand wheel connected to said phaser.

27. The apparatus of claim 25 in which said means for separating a predetermined number of said individual flexible products from the stack comprise count fingers movable from a position adjacent said stack of individual flexible products to a position separating said stack into a predetermined number of individual flexible products.

28. In an apparatus for the sequential handling and delivery of individual flexible products including means for transferring said flexible products to a delivery point while maintaining substantially the same spacing between said products, said means including a vacuum transfer drum having a plurality of annular grooves about the periphery thereof, and means for rotating said drum;

said vacuum transfer drum including a vacuum source, and a plurality of vacuum ports about the outer periphery of said transfer drum and communicating with said vacuum source for securing the leading edges of said flexible products to the outer surface of said transfer drum; and means for adjusting the point at which the vacuum at each successive port is terminated, said means comprising a movable slug including means associated with said slug for advancing or retarding the position of said slug, and means for providing an indication of the position of said slug, said means for advancing and retarding the position of said slug being capable of operation while said apparatus is in operation.

* * * * *